US010125601B2

(12) United States Patent
Rose et al.

(10) Patent No.: US 10,125,601 B2
(45) Date of Patent: Nov. 13, 2018

(54) COLLOIDAL-CRYSTAL QUANTUM DOTS AS TRACERS IN UNDERGROUND FORMATIONS

(75) Inventors: Peter E. Rose, Salt Lake City, UT (US); Michael H. Bartl, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 493 days.

(21) Appl. No.: 13/041,276

(22) Filed: Mar. 4, 2011

(65) Prior Publication Data

US 2011/0214488 A1 Sep. 8, 2011

Related U.S. Application Data

(60) Provisional application No. 61/310,681, filed on Mar. 4, 2010, provisional application No. 61/360,666, filed on Jul. 1, 2010.

(51) Int. Cl.
*E21B 47/10* (2012.01)

(52) U.S. Cl.
CPC ..... *E21B 47/1015* (2013.01)

(58) Field of Classification Search
CPC .. E21B 47/1015; E21B 43/267; E21B 47/102; C09K 2208/10
USPC ..... 73/152.18, 152.29, 152.31
See application file for complete search history.

(56) References Cited

U.S. PATENT DOCUMENTS 3,993,131 A * 11/1976 Riedel ..... 436/27
4,731,531 A 3/1988 Handke
5,049,743 A * 9/1991 Taylor ..... E21B 43/26 250/260
5,077,471 A * 12/1991 Smith et al. ..... 250/260
5,413,179 A 5/1995 Scott, III
5,441,110 A 8/1995 Scott, III
6,261,779 B1 * 7/2001 Barbera-Guillem ..... G01N 33/54306 435/6.11
6,607,036 B2 * 8/2003 Ranson et al. ..... 166/302
6,645,769 B2 * 11/2003 Tayebi ..... E21B 47/1015 166/246
6,691,780 B2 * 2/2004 Nguyen et al. ..... 166/254.1
6,828,142 B2 * 12/2004 Barbera-Guillem ..... G01N 33/54306 435/287.2
7,280,204 B2 * 10/2007 Robinson et al. ..... 356/318
7,384,795 B2 * 6/2008 Lagwinski et al. ..... 436/180
(Continued)

FOREIGN PATENT DOCUMENTS

WO WO 2005103446 A1 * 11/2005
WO WO 2007/019585 2/2007
(Continued)

OTHER PUBLICATIONS

Pouya et al. "Single quantum dot (QD) imaging of fluid flow near surfaces" 2005, Experiments in Fluids, 39: pp. 784-786.*
(Continued)

*Primary Examiner* — John Fitzgerald
(74) *Attorney, Agent, or Firm* — Thorpe North & Western, LLP

(57) ABSTRACT

Colloidal-crystal quantum dots as tracers are disclosed. According to one embodiment, a method comprises injecting a solution of quantum dots into a subterranean formation, and monitoring a flow of the quantum dots from the subterranean formation to determine a property of the subterranean formation.

25 Claims, 4 Drawing Sheets

(56) References Cited

U.S. PATENT DOCUMENTS 7,472,748 B2* 1/2009 Gdanski et al. ..... 166/250.1
7,611,750 B2* 11/2009 Yi et al. ..... 427/218
7,638,761 B2 12/2009 Csutak
7,782,460 B2* 8/2010 DiFoggio et al. ..... 356/409
7,795,037 B2* 9/2010 Lagwinski et al. ..... 436/180
7,902,545 B2* 3/2011 Csutak ..... 257/14
7,907,277 B2* 3/2011 Csutak ..... 356/317
7,921,910 B2* 4/2011 Wilson et al. ..... 166/250.12
8,162,049 B2* 4/2012 Rose ..... E21B 43/26 166/250.1
8,168,570 B2* 5/2012 Barron et al. ..... 507/269
8,342,241 B2* 1/2013 Hartshorne et al. ..... 166/252.6
2001/0036667 A1* 11/2001 Tayebi et al. ..... 436/56
2003/0196805 A1 10/2003 Boney et al.
2004/0101822 A1* 5/2004 Wiesner ..... B82Y 30/00 435/5
2004/0162224 A1* 8/2004 Nguyen et al. ..... 507/200
2005/0274510 A1 12/2005 Nguyen et al.
2006/0029802 A1* 2/2006 Ying ..... C30B 29/60 428/403
2006/0046297 A1* 3/2006 Ball ..... 436/28
2006/0152383 A1 7/2006 Yamate et al.
2006/0228554 A1* 10/2006 Tan ..... A61K 49/183 428/404
2007/0034373 A1* 2/2007 McDaniel et al. ..... 166/250.1
2007/0199109 A1* 8/2007 Yi et al. ..... 977/811
2007/0202318 A1* 8/2007 Smith et al. ..... 428/323
2008/0133193 A1* 6/2008 Gdanski et al. ..... 703/10
2008/0165356 A1* 7/2008 Difoggio et al. ..... 356/326
2008/0196895 A1 8/2008 Watters et al.
2008/0210421 A1* 9/2008 Wilson et al. ..... 166/254.1
2008/0258115 A1* 10/2008 Ying ..... C30B 29/60 252/500
2008/0300153 A1* 12/2008 Crews et al. ..... 507/269
2009/0025470 A1* 1/2009 Green et al. ..... 73/152.18
2009/0045814 A1* 2/2009 Csutak ..... 324/333
2009/0050573 A1* 2/2009 Ward et al. ..... 210/748
2009/0069481 A1* 3/2009 Zhang ..... G01N 21/658 524/413
2009/0082231 A1* 3/2009 Shmotiev et al. ..... 507/269
2009/0087911 A1* 4/2009 Ramos ..... E21B 47/1015 436/27
2009/0087912 A1* 4/2009 Ramos ..... C09K 8/032 436/27
2009/0137433 A1* 5/2009 Smith et al. ..... 507/271
2009/0139244 A1* 6/2009 Ullo et al. ..... 62/3.6
2009/0205826 A1* 8/2009 Rodriguez ..... 166/280.2
2009/0283748 A1* 11/2009 Csutak ..... 257/14
2009/0284259 A1* 11/2009 Csutak ..... 324/333
2009/0288820 A1* 11/2009 Barron et al. ..... 166/249
2010/0006283 A1* 1/2010 Collins et al. ..... 166/261
2010/0006750 A1* 1/2010 Zahlsen et al. ..... 250/259
2010/0019211 A1* 1/2010 Yi et al. ..... 252/519.4
2010/0032156 A1* 2/2010 Petty et al. ..... 166/252.1
2010/0119697 A1* 5/2010 Baran, Jr. ..... 427/8
2010/0148049 A1* 6/2010 Csutak ..... 250/254
2010/0304418 A1* 12/2010 Moussavi et al. ..... 435/28
2010/0307745 A1* 12/2010 Lafitte et al. ..... 166/250.12
2010/0314105 A1* 12/2010 Rose ..... E21B 43/26 166/250.1
2011/0073811 A1* 3/2011 Ying ..... C30B 29/60 252/500
2011/0146974 A1* 6/2011 Hartshorne et al. ..... 166/250.12
2011/0171749 A1* 7/2011 Alocilja et al. ..... 436/501
2011/0189102 A1* 8/2011 Kairdolf et al. ..... 424/9.61
2011/0240287 A1* 10/2011 Hartshorne et al. ..... 166/250.12
2012/0068126 A1* 3/2012 Bartl et al. ..... 252/519.2
2012/0085555 A1* 4/2012 Collins et al. ..... 166/400
2012/0090533 A1* 4/2012 Bartl et al. ..... 117/69
2012/0142111 A1* 6/2012 Tour ..... B82Y 30/00 436/27
2012/0181020 A1* 7/2012 Barron et al. ..... 166/250.1
2012/0318503 A1* 12/2012 Kanj et al. ..... 166/252.6
2013/0031970 A1* 2/2013 Freese et al. ..... 73/152.18
2013/0084643 A1* 4/2013 Commarieu et al. ..... 436/27
2013/0180720 A1* 7/2013 Al-Dahlan et al. ..... 166/307
2013/0269423 A1* 10/2013 Angelescu ..... 73/54.01

FOREIGN PATENT DOCUMENTS

WO WO 2010/083431 7/2010
WO WO 2010/085463 7/2010

OTHER PUBLICATIONS

Pouya et al. "Experimental Evidence of diffusion-induced bias in near-wall velocimetry using quantum dot measuremnts," Exp. Fluids (2008) 44:1035-1038.*
PetroWiki "Reservoir perssure and temperature," web document, 2015, 4 pages.*
ICGC "What is a geothermal reservoir? Types of geothermal reservoirs," web document, Aug. 2014, 2 pages.*
"Hydraulic Fracturing Fluids-Composition and Additives," 2017, Geology.com, pp. 1-4.*
"Fracturing Fluids and Additives," 2017, PetroWiki, pp. 1-4.*
Freudenthal et al.; Quantum nanospheres for sub-micron particle image, velocimetry; Experiments in Fluids; 2007; pp. 525-533; vol. 43; Springer-Verlag.
Guasto; et al.; Statistical particle tracking velocimetry using molecular and quantum dot tracer particles; Experiments in Fluids; 2006; pp. 869-880; vol. 41; Springer-Verlag.
Rose et al.; A Comparison of Hydraulic stimulation Experiments at the Soultz, France and Coso, California Engineered Geothermal Systems; Proceedings of the Thirty-First Workshop on Geothermal Reservoir Engineering; Jan. 30-Feb. 1, 2006; 5 pages; Stanford University, Stanford, California.
Rose et al; The Estimation of Reservoir Pore Volume From Tracer Data; Proceedings of the Twenty-Ninth Workshop on Geothermal Reservoir Engineering; Jan. 26-28, 2004; 9 pages; Stanford University, Stanford, California.
Shook; A Systematic method for Tracer Test Analysis: An Example Using Beowawe Tracer Data; Proceedings of the Thirtieth Workshop on Geothermal Reservoir Engineering; Jan. 31-Feb. 2, 2005; 6 pages; Stanford Univesity, Stanford, Californai.
Wikipedia; Solution; Wikipedia, the free encyclopedia; modified Aug. 10, 2014; 6 pages; http://en.wikipedia.org/w/index.php?title=Solution&oldid=620643840.
Rose et al.; The Potential for the Use of Colloidal-Crystal Quantum Dots as Tracers in Geothermal and EGS Reservoirs; Geothermal Resources Council Transactions; Oct. 2010; pp. 723-728; Geothermal Resources Council.
Rose et al.; Quantum Dots as Tracers in Geothermal and EGS Reservoirs; Proceedings, Thirty-Sixth Workshop on Geothermal Reservoir Engineering, Stanford University, Stanford, California; Jan. 31-Feb. 2, 2011; 7 pages; Thirty-Sixth Workshop on Geothermal Reservoir Engineering, Stanford University, Stanford, California.

* cited by examiner

COLLOIDAL-CRYSTAL QUANTUM DOTS AS TRACERS IN UNDERGROUND FORMATIONS

RELATED APPLICATIONS

This application claims the benefit of and priority to U.S. Provisional Patent Application Nos. 61/310,681 filed Mar. 4, 2010 and 61/360,666 filed Jul. 1, 2010, each of which is incorporated by reference herein.

FIELD OF TECHNOLOGY

The present application is directed to systems and methods for using colloidal-crystal quantum dots as tracers in underground formations.

BACKGROUND

The creation of an Enhanced Geothermal Systems (EGS) reservoir involves fracturing a subterranean formation or a plurality of subterranean formations. Water is circulated from an injection well, through the fractures where it is heated. The hot water or heat from the formation is produced from one or more production wells some distance away from the injection well and used for generating electricity. Fractures within subterranean formations are typically created in an un-cased or open-hole environment by pumping water from the surface down into the well. Water pressure opens a network of fractures in the open-hole section of the subterranean formation having the lowest fracture initiation pressure. The fracture network propagates away from the wellbore in a specific orientation that is related to existing stresses in the subterranean formation. However, a relatively small section of the open-hole section of the subterranean formation is actually fractured. Other locations in the open-hole section having higher fracture initiation pressures that are typically deeper in the subterranean formation remain unstimulated.

Unstimulated regions within the subterranean formation are an untapped source of energy for power generation and the efficiency of power generation on a per well basis remains relatively low. The cost of drilling and completing wells can range from half to 80 percent of the total cost of an EGS project. Therefore, reducing the number of wells for a given project can have a significant impact on the overall cost of the project and ultimately the cost of power production. Understanding the nature of fractures in underground formations also has a significant impact on EGS development.

SUMMARY

Colloidal-crystal quantum dots as tracers are disclosed. According to one embodiment, a method comprises injecting a solution of quantum dots into a subterranean formation, and monitoring a flow of the quantum dots from the subterranean formation to determine a property of the subterranean formation.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1:
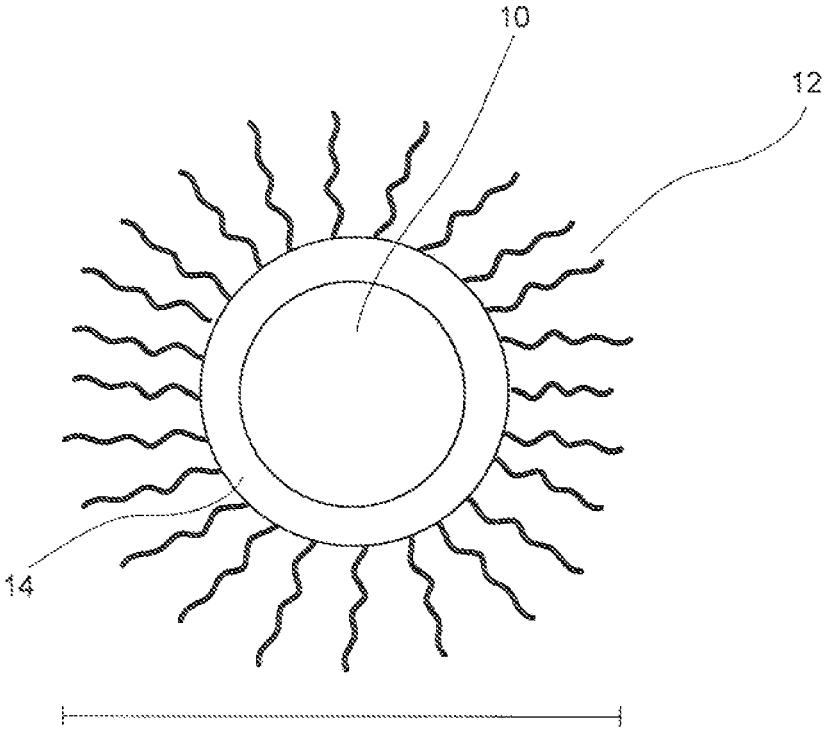
FIG. 1 shows a schematic depiction of an exemplary water-soluble core-shell nanocrystal quantum dot tracer, according to one embodiment.

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

In describing and claiming the present invention, the following terminology will be used.

The singular forms "a," "an," and "the" include plural referents unless the context clearly dictates otherwise. Thus, for example, reference to "a quantum dot" includes reference to one or more of such materials and reference to "injecting" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Quantum Dots

A method of using quantum dots to characterize a property of a subterranean formation is provided. The method includes injecting a solution of quantum dots into a subterranean formation and monitoring a flow of the quantum dots in the subterranean formation to determine a property of the subterranean formation. The method can be applied and used to characterize properties of a variety of subterranean formations. In one embodiment, the subterranean formation can be a geothermal reservoir. In another embodiment, the subterranean formation can be an oil reservoir.

These methods can be used to characterize several different properties of a subterranean formation. In one embodiment, the property being characterized can be the fracture-surface area of the subterranean formation. The method can be used to calculate both near-wellbore fracture-surface area as well as interwell fracture-surface area, either individually or through simultaneous measurement. In another embodiment, the property being characterized can be the volume of the subterranean formation. The calculation of the surface area or volume can be done using analytical and/or numerical modeling that is based on the diffusion, sorption and/or thermal stability of the quantum dot tracers and/or secondary tracers within subterranean formulations. Once such a model is designed, constructed, and calibrated, the surface area can be calculated through the process of inversion.

When the present method is used to characterize the fracture-surface area of the subterranean formation, monitoring can include quantifying the flow-rate of the quantum dots through the formation, calculating the flow rate of the fluid within the subterranean formation, and then calculating the fracture-surface area of the subterranean formation based on these calculations. Monitoring of the flow rate of the quantum dots in the subterranean formation can be monitoring flows within the formation (e.g. down the wellbore) using downhole technology or it can be done at the surface of the well bore as the fluid and quantum dots leave the subterranean formation (e.g. at the wellhead or subsequent fluid flow path).

In one embodiment, the property being characterized can be newly created fractures. Newly created fractures refer to areas of a subterranean formation that are recently fractured or opened through subterranean fracturing techniques. When characterizing new fracture areas injecting can include injecting a fracture fluid in conjunction with the solution of quantum dots into the subterranean formation. The quantum dots can be added to the fracture fluid to form a tracer-tagged fracture fluid. The fracture fluid and the quantum dots can penetrate the newly opened fractures in the well during the pressurized fracturing stage. Once the pressure is removed or reduced, the wellbore can be monitored to identify locations where quantum dots emerge from the formation. Typically, such a procedure is applied to a well which has been cased but not yet lined. In one embodiment, monitoring can be included prior to the injection of the quantum dots and the fracture fluid in order to identify pre-existing sealed fractures in the subterranean formation. In other embodiments, the method can include fracturing the subterranean formation prior to the injecting of the quantum dots. The concentration of the quantum dots within the fracture fluid can vary considerably. The concentration can be sufficient to allow measurement and detection thereof. Generally, very low concentrations can be detected (e.g. down to about 1 parts per billion), although higher concentrations can also facilitate visual qualitative identification of new fractures so that concentrations up to about 1 part per million or higher can be used.

Colloidal nanocrystal quantum dots are small crystallites of semiconductors in the size range of 1 to about 20 nm and composed of a few hundred to several thousands of atoms. As a result of quantum size effects and strongly confined excitons, quantum dots display unique size and shape-related electronic and optical properties. In particular, they can be made to fluoresce over a wide range, including the visible and near infrared (NIR) regions of light—regions where naturally fractured geothermal and other subterranean reservoirs and stimulation created fractures in EGS and other stimulated reservoirs waters possess very little interference. The excellent sensing/tracing ability of colloidal nanocrystals is rooted in their unique structure. While the inorganic semiconducting nanocrystal core delivers tunable emission colors (ranging from the visible to the NIR range), the surface chemistry of colloidal quantum dots can independently be adjusted by the choice of ligands to optimize their interaction with the sensing environment (e.g., hydrophilic/hydrophobic, chemically functional groups, positively/negatively charged surface, etc.). Thus, quantum dot tracers can be designed to possess all of the qualities of the conventional conservative tracers (e.g. the naphthalene sulfonates), or be converted to reactive tracers depending on the surface treatment. Such quantum dot tracers can be used for geothermal, EGS, groundwater or oil tracing applications including the use of the present novel tracers to characterize near-wellbore and interwell fracture-surface area resulting from hydraulic stimulation processes.

The quantum dots can include hydrophilic ligands and/or silica shells. The quantum dots used in the methods disclosed herein can be made of any material known in the art. Generally, materials which emit or re-emit energy can be used and can include fluorescent responsive, light responsive, electrically charged, radiation emitting, or other materials. In one embodiment, the quantum dots can include a semiconductor material. Non-limiting examples of semiconductor materials from which the quantum dots can be formed can include cadmium, lead, zinc, mercury, gallium, indium, cobalt, nickel, iron, or copper as the cationic component and sulfide, selenide, telluride, oxide, phosphide, nitride, or arsenide as the anionic component and combinations thereof. Non-limiting specific examples include cadmium selenide, cadmium telluride, lead sulfide, and lead selenide.

These semiconducting nanocrystals deliver tunable emission colors, ranging from the visible to the infrared. The quantum-dot tracers that fluoresce from the visible into the near-IR can be synthesized with varying diameters that render them variably diffusive. A particular fluorescence (color) can be associated with a particular diameter and, therefore, a particular diffusivity. In combination with numerical/analytical models, this property can allow for a determination of fracture surface area adjacent to an EGS wellbore during an injection/backflow experiment as part of a hydraulic stimulation.

In one embodiment, the quantum dots can be made using low-temperature methods described in "Low-Temperature Synthesis of Colloidal Nanocrystals," PCT International Patent Application No. PCT/US2010/021226, filed Jan. 10, 2010 and "Post-Synthesis Modification of Colloidal Nanocrystals," PCT International Patent Application No. PCT/US2010/021461, filed Jan. 20, 2010, which are both incorporated by reference herein. The present method enables the fabrication of the quantum dots with narrow size distributions and therefore narrow emission bands of only several tens of nanometers. The quantum dot tracers therefore possess sufficiently distinct emission spectra that can be simultaneously measured by relatively simple and inexpensive spectroscopic techniques. The quantum dot tracers used in the methods disclosed herein can have at least three distinct fluoresce spectra: visible (400-750 nm), near IR (800-950 nm), and longer IR wavelengths (950-2000 nm). In one embodiment, the quantum dots can have an emission wavelength range of about 450 nm to about 650 nm and be made from cadmium selenide. In another embodiment, the quantum dots can have an emission wavelength range of from about 600 nm to about 750 nm and can be made from cadmium telluride. In still a further embodiment, the quantum dots can have an emission wavelength range of from about 750 nm to about 2000 nm and be made from lead sulfide or lead selenide. It is also understood that a solution of quantum dots is not meant to indicate dissolution of the quantum dots.

The quantum dots can be substantially homogenous or can be manufactured to have a core-shell structure. In order to optimize the photoluminescence emission yield, the nanocrystals can be synthesized as so-called core-shell structures, for example, by surrounding them with a thin layer of cadmium sulfide (CdS). Other combinations of core and shell material can also be suitable. The shell materials can include semiconductor materials such as, but not limited to, cadmium, lead, zinc, mercury, gallium, indium, cobalt, nickel, iron, or copper as the cationic component and sulfide, selenide, telluride, oxide, phosphide, nitride, or arsenide as the anionic component and combinations thereof. Non-limiting specific examples include cadmium sulfide, cadmium telluride, lead sulfide, and lead sulfide. Regardless of the structure of the quantum dots, the dots can also include ligands attached on the surfaces of the particles. FIG. 1 shows one embodiment of a quantum dot, according to one embodiment. The quantum dot includes a nano-crystal core 10 surrounded by a shell 14. The embodiment shown in FIG. 1 also includes ligands 12 attached to the surface of the quantum dot. The quantum dot can have a diameter of 3-15 nm, according to one embodiment.

Through modifications of surface properties and diameters, the quantum dots can be transformed into reactive tracers that are capable of sorbing and diffusing in predictable ways with fracture surfaces and can therefore be used to determine fracture surface areas. The modification of the surface chemistry of the nonsorbing quantum dots can allow for reversible sorption on negatively charged EGS rocks.

In one embodiment, the quantum dots can have one or more hydrophilic ligands attached thereto. Non-limiting examples of hydrophilic ligands that can be attached to the surface of the quantum dots include alkanes, alkenes or alkynes functionalized with one or more transit control groups including thiol groups, amine groups, carboxy groups, amide groups, citrate groups, and combinations thereof. In one embodiment, the alkane, alkene, or alkyne can have from 2 to 18 carbon atoms. In another embodiment, the alkane, alkene, or alkyne is a C2-C4 chain. In some embodiments it can be desirable that the alkane, alkene, or alkyne is substantially linear, having little to no branching (e.g. n-alkyls). These groups can have one end which is connected to a coupling group or the quantum dot surface and an opposite end including a transit control group which can either sorb or repel fracture surfaces. The transit control groups can be positively or negatively charged depending on the desired degree of sorbing with formation surfaces. For example, depending on the nature of the subterranean formation, positively charged transit control groups may cause enhanced sorbing of the quantum dots while negatively charged transit groups may inhibit sorbing of the quantum dots and facilitate transit of the quantum dots through the subterranean formation. In another embodiment, the quantum dots can include hydrophobic ligands attached to the surface of the dots, but such ligands would render the quantum dots insoluble in aqueous media.

The hydrophilic ligands can be attached to the quantum dots using a coupling group. Non-limiting examples of coupling groups that can be used to attach the hydrophilic ligand can include amino coupling groups, mercapto coupling groups, hydroxyl coupling groups, carboxy-silane coupling groups, and combinations thereof. When the shell of the quantum dot is silica, it can be desirable to utilize a carboxy-silane coupling group. Surface functionalization of quantum dots can be accomplished using a variety of processes and will depend somewhat on the specific composition of the quantum dot outer surface and the ligand.

Other surface modifiers can also be attached to the surface of the quantum dots. Specifically, in one embodiment, scale inhibitor compositions can be attached to the surface of the quantum dots. Non-limiting examples of scale inhibitors that can be attached to the surface of the quantum dots include polycarboxylates, polyacrylates, polymaleic anhydrides, and combinations thereof. These scale inhibitors, when attached to the quantum dots, can act to reversibly sorb the dots within the subterranean formulations while allowing the quantum dots to retain their fluorescence properties.

Figure 2:
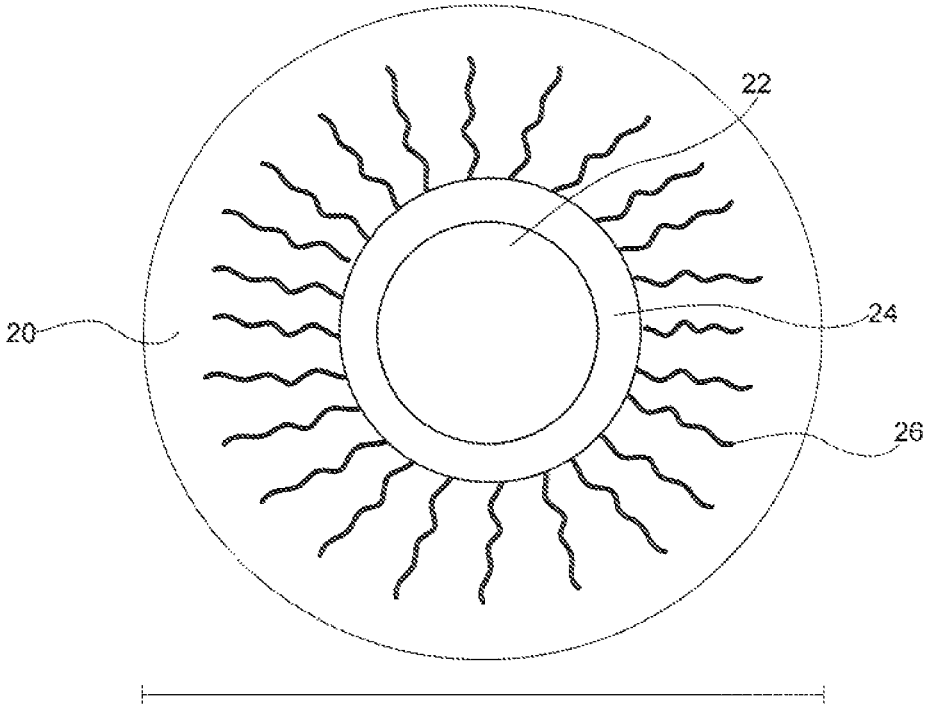
FIG. 2 shows a schematic depiction of an exemplary silica-glass coated core-shell quantum dot tracer with adjustable overall thickness, according to one embodiment.

The quantum dots used can optionally be substantially encapsulated in a silica layer. One embodiment of such an encapsulated dot is shown in FIG. 2. The encapsulated quantum dot includes the nanocrystal core 22, the shell coating 24 along with the attached ligands 26. Such encapsulated dots, can be functionalized with ligands or left without such functionalization. The thickness of the silica coating can be varied depending on the desired diameter of the finished encapsulated quantum dot. The encapsulated quantum dot can have a diameter of about 5 nm to about 25 nm, according to one embodiment.

Figure 3:
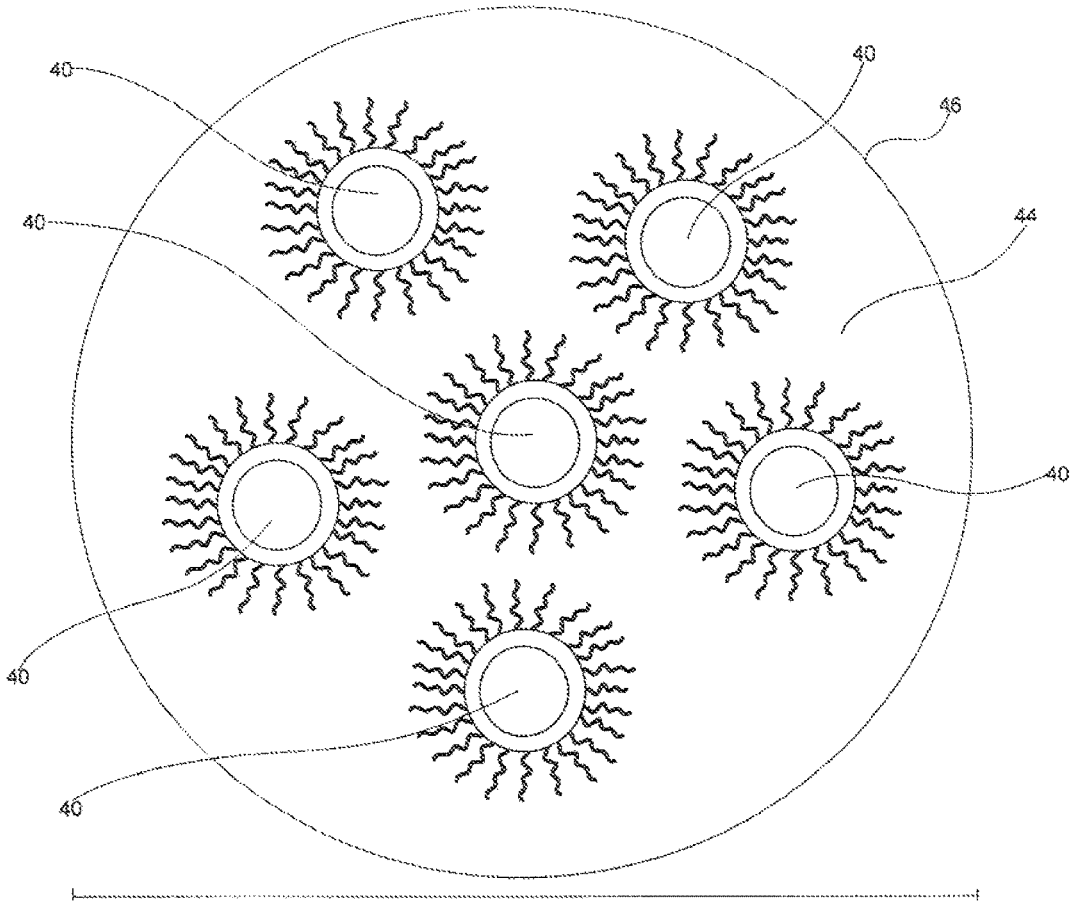
FIG. 3 shows an illustration of one an exemplary nanosphere showing the enhancement of fluorescence achieved by increased loading of quantum dots, according to one embodiment.
Figure 5:
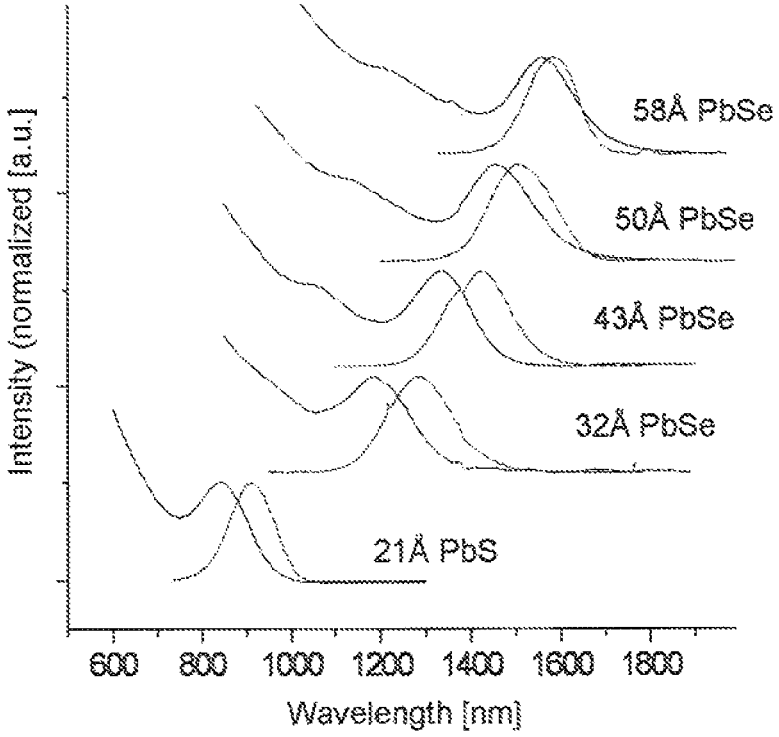
FIG. 5 shows an exemplary near infrared absorption (blue spectra) and photoluminescence emission (red spectra) of colloidal PbS and PbSe quantum dots, according to one embodiment.

In one embodiment, a plurality of quantum dots, e.g. at least two, can be substantially encapsulated into a single silica nanosphere prior to injection into the subterranean formation. FIG. 3 shows an embodiment of a plurality of quantum dots 40 that are encapsulated in a silica layer 44 to form a nanosphere 46. The silica nanospheres containing a plurality of quantum dots can have a diameter of about 5 nm to about 150 nm. In one embodiment, the nanospheres can have a diameter of about 10 nm to about 100 nm. The number and types of quantum dots present in a single nanosphere can vary depending on the intended target measurement, the type of subterranean formation into which the dots will be injected, etc. In one embodiment, the silica nanosphere can substantially encapsulate a first quantum dot that fluoresces at a first wavelength range and a second quantum dot that fluoresces at a second wavelength range. For example, blue, green, red, NIR emitting quantum dots can be selectively incorporated into silica spheres with overall diameters of 10, 25, 50 and 100 nm, respectively (FIG. 5). Typically, from two to many dots of a common type can be encapsulated in each nanosphere. Fabrication of such glass spheres can be done by sol-gel colloidal synthesis methods or other suitable methods. Manufacturing of the silica encapsulated quantum dots can be accomplished using methodology known in the art. In short, core-shell quantum dots with a thin layer of silica on their surface can be immersed in a solution containing molecular silica-glass precursors. The reaction conditions can be adjusted so that the silica-coated nanocrystals act as seed colloids for controlled condensation of silica-glass precursors on their surface, resulting over time in the formation of spherical objects with adjustable sizes (depending on time of reaction). Since spheres differing in sizes over an order of magnitude will have distinctly different diffusive properties, their relative retention times will contain valuable information about fracture size, morphologies, surface area and spacing. Due to the electronic and optical properties of nanocrystal quantum dots, information of relative retention of all sphere sizes can be interrogated by simultaneously exciting all four emission colors by a single-wavelength source. Further, composite nanospheres can allow for increased fluorescence to facilitate measurement.

The silica coatings increase the diameters of the quantum dots, and, depending on coat thickness and other factors, can alter the particle density in an undesirable way. Accordingly, the silica-encapsulated quantum dots can optionally include one or more organic compounds in the encapsulating layer. The silica layer can be deposited onto the quantum dots by wet-chemistry sol-gel methods in which silane-based silica precursor compounds such as silicon halides (fluoride, chloride, bromide, iodide) and/or alkoxides (e.g. tetra-alkoxy, alkyl-tri-alkoxy, di-alkyl-di-alkoxy, tri-alkyl-alkoxy, tetra-alkyl; in addition alkyl and/or alkoxy groups can possess functional units such as halides, hydroxyl, thiol, amine, carboxyl, amide, imide groups) are reacted with the quantum dots in aqueous or organic solvents or mixtures thereof.

Additionally, other encapsulation layers can be used including oxides of titanium, zinc, tungsten, molybdenum, copper, iron, nickel, tin, niobium, aluminum, cadmium, and mixed metal oxides from compounds listed above including silicon. The encapsulating layers can also contain organic polymeric layers which are incorporated during the sol-gel encapsulation process. Organic polymeric compounds can include, but are not limited to, homo- and block co-polymers and various surfactants. The organic polymers can provide the desired function while altering the density of the particle.

Once injected in to the subterranean formation, the flow of the quantum dots from the formation can be quantified. It is important to note that the term "from" as used to refer to the flow of the quantum dots "from the subterranean formation" can include the departure of quantum dots from within the subterranean formation as well as the flow of the quantum dots within a particular portion of the formation. Thus, quantification can occur outside the subterranean formation or within the subterranean formation using downhole instrumentation and techniques. Generally, the quantification of the quantum dots can be accomplished using a detector or quantification device that measures fluorescence. In one embodiment, the quantification is accomplished using size exclusion chromatography with a fluorescence detector. Standard size-exclusion chromatographic (SEC) methods can be used.

The quantum dots can be suspended within a carrier fluid prior to injection and the carrier fluid can then be injected with the quantum dots into the subterranean formation. Non-limiting examples of carrier fluids that can be used include, but are not limited to, water, petroleum-based solvents, fracture fluids, and combinations thereof. The selection of the carrier fluid for the quantum dots can be selected based on a number of factors, including the type of subterranean formation being analyzed.

The present quantum dots can be used with other conventional or conservative tracers and flow measurement techniques. Non-limiting examples of suitable secondary tracers include alpha-, beta-, or gamma-emitters (e.g. radioactive bromide), perhalogenated compounds (e.g. perfluoromethylcyclopentane), light-absorbing dyes (e.g. methylene blue), fluorescent dyes (e.g. fluorescein, rhodamine INT, eosin Y, etc.) and electrically charged compounds (e.g. lithium, sodium, chloride, bromide). Examples of detection approaches that can be used in detecting tracers include radioactivity, electron capture, fluorescence, absorption, and conductivity. These supplemental tracers can be reactive, conservative, or a mixture of both. Using a combination of conservative and reactive tracers can further facilitate measurement and calculation of formation performance characteristics.

EXAMPLES

Example 1—Design and Synthesis of Nonsorbing Quantum Dot Tracers

At least three distinct quantum dot tracers that fluoresce in the visible (400-750 nm), one that fluoresces in the near IR (800-950 nm), and one that fluoresces at longer IR wavelengths (950-2000 nm) are synthesized in sufficient quantity for subsequent testing. Four different compositions of colloidal nanocrystals (all with sizes varying from about 1 to 10 nm in diameter) are used to cover the targeted emission wavelength range from 450 to 1500 nm: cadmium selenide (CdSe; 450-650 nm), cadmium telluride (CdTe; 600-750 nm) and lead sulfide and selenide (PbS and PbSe; 750-2000 nm).

Semiconductor colloidal quantum dots (or nanocrystals) can be synthesized by relatively simple organometallic colloidal chemistry. A low-temperature (50-130° C.) organometallic nucleation and crystallization-based synthesis route for the fabrication of high-quality colloidal nanocrystals with narrow size distribution and tunable (size-dependent) electronic and optical properties has been developed. The method is discussed extensively in the previously referenced and incorporated PCT Applications of Bartl and Siy. The low-temperature route is in sharp contrast to conventional synthesis methods that require temperatures between 230° C. and 350° C. The lower temperature method enables synthesis of quantum dots at lower cost and in higher quantities than traditional higher temperature methods.

Figure 6:
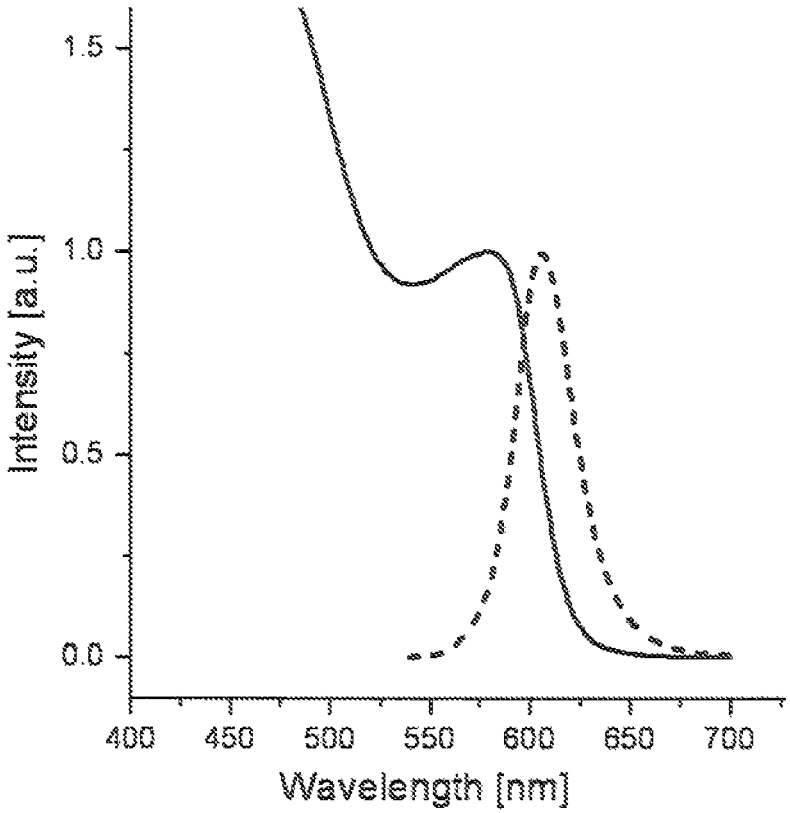
FIG. 6 shows an exemplary UV-visible absorption and photoluminescence emission spectra of CdSe nanocrystal quantum dots, according to one embodiment.

The lower temperature approach includes the nucleation of nanocrystals kinetically induced at lower temperatures (via optimized ligand concentration) compared to conventional methods. Low-temperature growth of these nuclei can be thermodynamically and kinetically driven (via optimized reaction species concentrations). For example, in order to fabricate cadmium selenide (CdSe) colloidal quantum dots, readily available molecular precursors can be reacted in an inert solvent in the presence of surface stabilizing ligands at a temperature of 50° C.-130° C. The low-temperature production methods can provide several advantages including: 1) better controlled (product quality) and up-scaling ability; 2) allows for the use of conventional (inexpensive, readily available, industry-tested) solvents and co-solvents; and 3) requires significantly lower engineering requirements/restrictions and can facilitate high-throughput fabrication and integration into commercial fabrication facilities. FIG. 6 shows the UV-vis absorption (full line) and photoluminescence emission (dotted line) spectra of CdSe nanocrystal quantum dots produced at low reaction temperatures and high yield.

Figure 4:
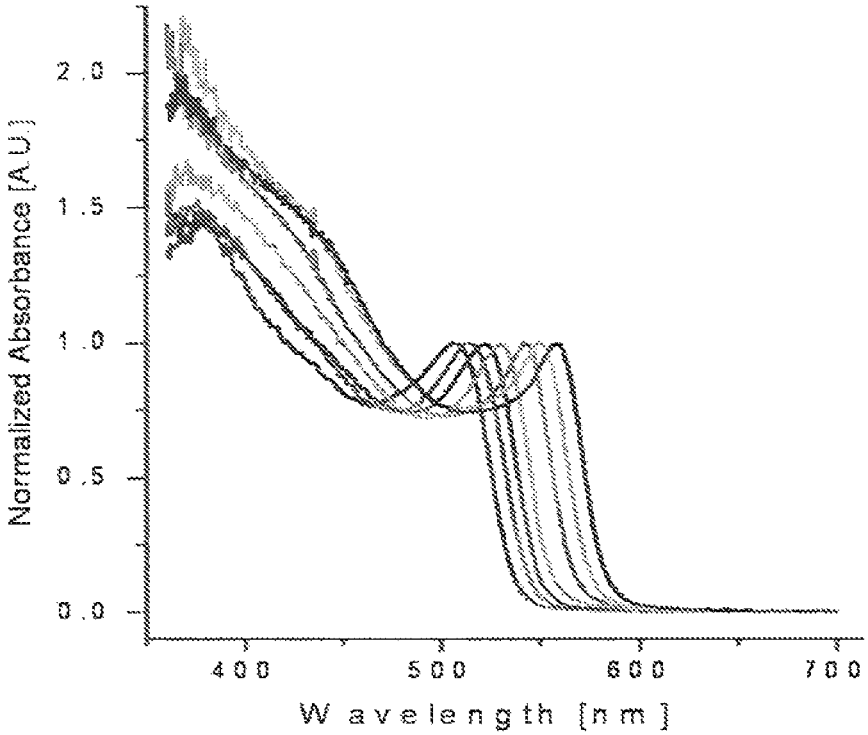
FIG. 4 shows a schematic depiction of exemplary reaction pathways for converting as-synthesized hydrophobic quantum dots (QDs) into water-soluble quantum dots, according to one embodiment.

The above described methods, particularly the low-temperature method, provide the ability to readily tune the synthesis conditions (temperature and length of crystallization) in order to fabricate size and shape-controlled monodisperse quantum dot samples with sizes ranging from about 1 to 20 nm. Since quantum-sized semiconductor nanocrystals display strongly confined exciton behavior, tuning their size results in tunable electronic and optical properties. For example, CdSe quantum dots can display photoluminescence emission colors from blue to green and red (and every color-shading in between) simply by varying their size. This is shown in FIG. 4, which displays UV-vis absorption spectra as well as photoluminescence spectra and images of CdSe quantum dots. Moreover, by fabricating quantum dots with different compositions (CdTe, PbS, PbSe etc.), the range can be extended from the visible into the NIR region of the electromagnetic spectrum (see FIG. 5), yielding a combined continuous range of tracers with available emission wavelengths from around 450 nm to more than 1500 nm.

Example 2—Surface-Modified Quantum Dots

The surface chemistry of highly-luminescent core-shell quantum dots can be tuned to give optimized interaction with the sensing/tracing environment. Two approaches can be used:

Fabrication of initially hydrophobic quantum dots using a low-temperature method and rendering them water-soluble by surface-ligand exchange (amine, carboxyl, or thiol-functionalized ligands).

Modification of the low-temperature synthesis route for the direct synthesis of hydrophilic nanocrystals with water-soluble surface ligands (citrate or hydroxyl-functionalized ligands).

While the latter requires less fabrication steps, the first strategy is better established and therefore will allow faster product availability with better control of size and properties of the synthesized quantum dot tracers. A schematic of the structure of water-soluble quantum tracers is shown in FIG. 1.

Example 3—Fabrication of Temperature and Corrosion-Stable Nonsorbing Quantum Dot Tracers Water-soluble core-shell nanocrystals are immersed in a solution containing amino or thiol-functionalized alkoxysilanes, which serve as the molecular precursor for the glassy silica layer. Formation of a continuous silica film is then induced by chemically cross-linking the alkoxysilane precursor and the thickness of the protective glassy layer is controlled by the length of reaction. The thickness can be about 2 nm-5 nm, resulting in total nanocrystal sizes between 5 nm and 25 nm. While this should be sufficient to protect the enclosed nanoparticles from corrosion and temperature, fine-tuning of the layer-thickness can be done in order to provide the desired temperature stability. The temperature stability of the quantum dots can be evaluated and tested using batch autoclave reactors, each tracer being screened for thermal stability under conditions of temperature, pressure and chemistry that simulate an environment in a subterranean formulation, e.g., a hydrothermal environment. For each tracer that survives the screening, its thermal decay kinetics can be determined.

Besides temperature and corrosion-stability, another advantage of silica-coated quantum dot tracers is that the overall size of the tracer can be controlled without affecting the intrinsic tracer properties (e.g., emission color). This can be made by applying a layer-by-layer approach to gradually and predictably increase the overall size of the quantum tracers. A schematic is depicted in FIG. 2. By changing the diameters, quantum dot tracers having contrasting diffusivities can be synthesized. These diffusivities can then be incorporated into a model that predicts fracture surface area adjacent to an EGS well based upon diffusive-tracer data from an injection/backflow experiment.

Example 4—Parameterize and Calibrate Numerical Model Using Injection/Backflow Experiment Results A numerical model used to determine fracture-surface area can be developed. Emphasis can be placed on verifying and parameterizing the target transport characteristics of the quantum dot tracers, especially their effective diffusivities relative to solute tracers and their nonsorbing behavior. It is important to note that any apparent sorption of the quantum dot tracers generally does not render them unusable for surface area estimation. Rates and capacities of sorption are proportional to surface area, so sorptive interactions can also be exploited to estimate surface area. The numerical model can be adapted to use sorptive interactions (or combined diffusive and sorptive behavior) to estimate surface area, and the necessary sorption rates and capacities can be estimated from laboratory flow reactor data.

Example 5—Quantum Dot Tracers

Commonly used high-temperature-stable tracers are organic fluorescent molecules with excitation and emission typically in the ultraviolet range of the electromagnetic spectrum. Since this range is readily spectrally polluted by many naturally occurring reservoir contaminants, high-temperature-stable tracer species with emission bands at longer wavelengths (visible and near infrared) are highly desired. In particular, visible (450 nm-750 nm) and near infrared-emitting tracers (at wavelengths around 800 nm-1000 nm) have reduced background absorption, fluorescence and light scattering in this range. Unfortunately, near infrared-emitting tracers based on organic dye molecules suffer, in general, from aggregation, photobleaching, and low fluorescence quantum yields. These obstacles, however, can be overcome by using semiconductor nanocrystals as the emitting tracer species. Quantum dots are small crystallites (1-10 nm in diameter) of semiconducting compounds with tunable electronic and optical properties and high fluorescence quantum yields.

CdSe-based quantum dots have been synthesized that are water-soluble and have tunable fluorescence in the visible spectrum. For this, synthesis results in CdSe quantum dots with citrate molecules attached to their surface, rendering them water-soluble. The synthesis conditions can be varied to fabricate quantum dots with different sizes (3 nm-5 nm in diameter), resulting in green, yellow and orange emission colors. Furthermore, core-shell structures can be synthesized by covering the CdSe quantum dots with a thin shell of crystalline CdS. This extra shell minimizes surface defects of the CdSe core crystallite and thereby enhances the fluorescence quantum yield. These core-shell architectures can be optimized to produce water-soluble quantum dots with fluorescence quantum yields approaching those of conventionally used organic dye tracers.

PbS quantum dots can also be fabricated. The advantage of PbS is an inherently smaller electronic band gap, which shifts electronic and optical properties of PbS quantum dots into the near infrared range. PbS quantum dots can have emission bands centered between 800 nm and 1000 nm. CdSe and PbS-based quantum dots can be made water-soluble and display tunable fluorescence emission in the visible and near IR range, including the important 800 nm to 1000 nm wavelength range.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A method, comprising:

injecting a solution of independent and distinct quantum dot tracers containing one or more quantum dots surface-modified with ligands that render the quantum dots water-soluble into a subterranean formation, and monitoring a flow of the quantum dot tracers from the subterranean formation to determine a pore volume of the subterranean formation, wherein the quantum dot tracers have a diameter of about 1 nm to about 150 nm, and wherein the quantum dot tracers are also thermally stable in a hydrothermal environment, wherein at least one of:

the quantum dot tracers comprise a combination of conservative and reactive tracers, the quantum dot tracers comprise conservative tracers and the solution further comprises a supplemental reactive tracer, or the quantum dot tracers comprise reactive tracers and the solution further comprises a supplemental conservative tracer.

2. The method of claim 1, wherein the quantum dots have a core-shell structure.

3. The method of claim 1, wherein the quantum dots include a semiconductor material substantially encapsulated by a layer composed of oxides of silicon, titanium, zinc, tungsten, molybdenum, copper, iron, nickel, tin, niobium, aluminum, cadmium, and mixed metal oxides from compounds listed above.

4. The method of claim 1, wherein the monitoring is done using size exclusion chromatography with a fluorescent detector.

5. The method of claim 1, wherein the method further comprises the step of fracturing the subterranean formation prior to the injecting of the quantum dot tracers.

6. The method of claim 1, wherein the injecting step occurs simultaneously with the step of fracturing the subterranean formation.

7. The method of claim 1, wherein the subterranean formation is a geothermal reservoir.

8. The method of claim 1, wherein the subterranean formation is an oil reservoir.

9. The method of claim 1, wherein the quantum dot tracers include a continuous silica film enclosing the quantum dots.

10. The method of claim 1, further comprising varying the diameter of the quantum dot tracers to vary the diffusivity of the quantum dot tracers.

11. The method of claim 1, wherein the quantum dots comprises a semiconductor material.

12. The method of claim 11, wherein the semiconductor material is selected from the group consisting of cadmium, lead, zinc, mercury, gallium, indium, cobalt, nickel, iron, or copper as a cationic component and sulfide, selenide, telluride, oxide, phosphide, nitride, or arsenide as an anionic component and combinations thereof.

13. The method of claim 1, wherein the quantum dots include a scale inhibitor attached thereto.

14. The method of claim 13, wherein the scale inhibitor is selected from the group consisting of polycarboxylates, polacrylates, polymaleic anhydrides, and combinations thereof.

15. The method of claim 1, wherein determining a pore volume of the subterranean formation includes quantifying a flow-rate of the quantum dot tracers and calculating a pore volume of the subterranean formation based upon the flow rate of the quantum dot tracers.

16. The method of claim 15, wherein the flow-rate is quantified using the flow of quantum dot tracers from the subterranean formation.

17. The method of claim 15, wherein the flow-rate is quantified using the quantum dot tracers within the subterranean formation.

18. The method of claim 1, wherein the ligands are hydrophilic ligands.

19. The method of claim 18, wherein the hydrophilic ligands are an alkane, alkene, or alkyne functionalized with one or more transit control groups selected from the group consisting of: thiol groups, amine groups, hydroxyl groups, carboxy, and amide groups, citrate groups, halide groups, and combinations thereof.

20. The method of claim 18, wherein the hydrophilic ligand is attached to the quantum dot through a coupling group selected from the group consisting of amino coupling groups, mercapto coupling groups, hydroxyl coupling groups, carboxy-silane coupling group, and combinations thereof.

21. The method of claim 1, wherein the quantum dot tracers comprise a plurality of the quantum dots substantially encapsulated into a single oxide nanosphere.

22. The method of claim 21, wherein the oxide nanosphere includes a plurality of quantum dots that all fluoresce at a common wavelength.

23. The method of claim 21, wherein the oxide nanosphere includes an organic polymeric compound.

24. The method of claim 1, wherein the quantum dot tracers are injected with a carrier fluid.

25. The method of claim 24, wherein the carrier fluid is selected from the group consisting of water, fracture fluids, petroleum-based solvents, and combinations thereof.

* * * * *